United States Patent [19]

Mayer

[11] 4,303,090

[45] Dec. 1, 1981

[54] CRANKCASE OIL RETURN VALVE

[75] Inventor: Donald K. Mayer, Bloomington, Minn.

[73] Assignee: Thermo King Corp., Minneapolis, Minn.

[21] Appl. No.: 131,306

[22] Filed: Mar. 18, 1980

[51] Int. Cl.[3] ..... F16K 31/12

[52] U.S. Cl. ..... 137/114

[58] Field of Search ..... 137/111, 114; 62/84

[56] References Cited

U.S. PATENT DOCUMENTS

| | | | |
|---|---|---|---|
| 3,219,102 | 11/1965 | Taylor | 62/81 X |
| 3,289,688 | 12/1966 | Malott | 137/114 |
| 3,978,685 | 9/1976 | Taylor | 62/84 X |

*Primary Examiner*—William R. Cline

*Attorney, Agent, or Firm*—E. C. Arenz

[57] ABSTRACT

This invention provides a direct oil return system from the accumulator tank in the refrigerant circuit of a transport refrigeration system to the crankcase of the compressor for returning oil entrained in the refrigerant to the oil sump. A pressure relief valve in the lubricating oil circulating system positively opens under the influence of oil pressure from the positive displacement oil pump whenever the compressor is operating to bleed excess oil from the pump back to the sump. The oil return line from the accumulator tank of the refrigeration system is connected to the valve to enter through another inlet port which opens in response to the pressure relief valve being opened and flows therethrough to another outlet in the valve also in communication with the sump. As the pressure relief valve and thus the inlet ports in the oil return line remain closed whenever the compressor is not operating, liquid refrigerant is unable to migrate therethrough to the sump and, in the heating mode of operation of the refrigerant system, which is the mode in which liquid refrigerant is most likely to be entrained in the returning oil, an external heat source heats the line draining the oil from the accumulator tank to vaporize the liquid refrigerant therein to prevent liquid refrigerant being returned to the sump when the compressor is operating.

2 Claims, 4 Drawing Figures

CRANKCASE OIL RETURN VALVE

BACKGROUND OF THE INVENTION

1. Field of the Invention:

This invention relates to a transport refrigeration system capable of providing both heating and cooling and more particularly to a direct oil return circuit for returning oil from the bottom of the accumulator tank of such a system directly to the refrigerant compressor crankcase.

2. Description of the Prior Art:

Reversible refrigeration systems (i.e., systems capable of operating in a heating mode or a cooling mode) generally include suction accumulator tank providing a general tranquil environment in which the refrigerant vapor and liquid can be separated. In the normal cooling mode, the refrigerant is vaporized in the evaporator and such accumulator tank essentially has no other function; however, in the heating mode of the particular reversible refrigeration system shown by U.S. Pat. No. 3,219,102, of common assignee, the accumulator tank provides the evaporator function in lieu of the normal condenser coils. Under such conditions, the accumulator tank functions as the evaporator in the system and has a substantial quantity of liquid refrigerant delivered to it. Also, during "off" periods there may be migration of the liquid refrigerant from the warmer evaporator to the accumulator tank such as when the temperature of the ambient air surrounding the tank and compressor (and thus the temperature of these components) is less than the temperature of the interior of a truck trailer housing the evaporator. By providing external heat to the accumulator tank, and a high-level discharge from the accumulator to the suction of the compressor, the liquid refrigerant therein is vaporized and discharged to the compressor, minimizing slugging damage that can occur when liquid refrigerant is ingested into the compressor cylinders. Also, an inherent characteristic of refrigeration systems is the tendency of the compressor to pump lubricating oil from the compressor discharge throughout the rest of the system. Without some special provision, such circulating oil in the above-described system would eventually become trapped in the bottom of the suction accumulator tank. Thus, such refrigeration systems generally utilize either one of two methods for returning the lubricating oil from the accumulator tank to the compressor sump.

The first method comprises an aspirating device, such as an aspirating U-tube briefly described in commonly assigned U.S. Pat. No.3,978,685, which includes a U-tube within the accumulator tank having a high-level refrigerant inlet (so as to receive the vapor in the tank) for discharging to the compressor inlet. The U-tube has an oil opening in the bottom, generally adjacent the bottom of the tank, wherein oil can be aspirated into the vapor stream flowing through the tube back to the compressor. Such oil return system has several deficiencies, including:

(1) The vapor flow restriction imposed by the oil aspiration system in the accumulator tank impairs the compressor capacity;

(2) Because of the vapor velocities within the compressor suction inlet chamber, an undesirably high proportion of the oil aspirated into the refrigerant vapor remains entrained in the refrigerant and recirculated therewith, thus penalizing the refrigerant mass flow and the heat transfer effectiveness of the various coils; and, (3) The available oil supply in the compressor crankcase is diminished by the amount of oil in circulation and lodged in the accumulator.

Thus, a reduction in the amount of circulating oil and/or returning the oil to the compressor sump without the necessary vapor flow restriction of the aspiration system would improve the performance of the refrigeration system.

Another method of returning lubricating oil is through a separate oil-return line which runs directly from the bottom of the accumulator tank to the compressor crank case to drain oil directly to the sump. In this system, specific provisions are desirable to prevent crankcase ingestion of liquid refrigerant which may also be in the accumulator, such as a flow restriction to limit liquid refrigerant ingestion to allowable levels and a shut-off mechanism to prevent migration of liquid refrigerant to the compressor during the "off" cycle of the system.

In previous systems of this nature, the shut-off mechanisms have included solenoid actuated valves or liquid level actuated valves that prevented migration of the refrigerant to the sump during the "off" cycle. In transport refrigeration systems, the use of liquid-level valves is unpredictable because of the vibration and inertial shocks to which they are subjected during over-the-road use. Further, such components add to the complexity and the cost of such a refrigeration system. Also, it is known to provide an external heat source for the oil return line from the accumulator tank to the compressor sump which has the dual effect of vaporizing most of the liquid refrigerant passing therethrough and which in turn causes a flow restriction in the return line, effectively metering the rate of the return flow.

SUMMARY OF THE INVENTION

The present invention provides an oil return system of the latter type above referred to having a shut-off valve in the oil return line from the bottom of the accumulator tank to the compressor sump. The shut-off valve is actuated by, and in fact is integral with, the pressure regulating valve in the oil recirculating line. The pressure regulating valve opens whenever the compressor is actuated to bleed off excess pumping capacity of a positive displacement oil circulating pump within the compressor. Opening of the pressure relief valve also opens the shut-off valve so it too is open only when the compressor is operating. At all other times, the shut-off valve is closed to prevent liquid refrigerant migration into the compressor sump. Also, the oil return line from the accumulator tank is heated, with one source of the heat being the compressor discharge vapor, to vaporize liquid refrigerant in the oil return during the "heat mode" which as previously explained is the mode most apt to cause liquid refrigerant to be mixed with the oil in the accumulator tank.

DESCRIPTION OF THE PREFERRED EMBODIMENT

Figure 1:
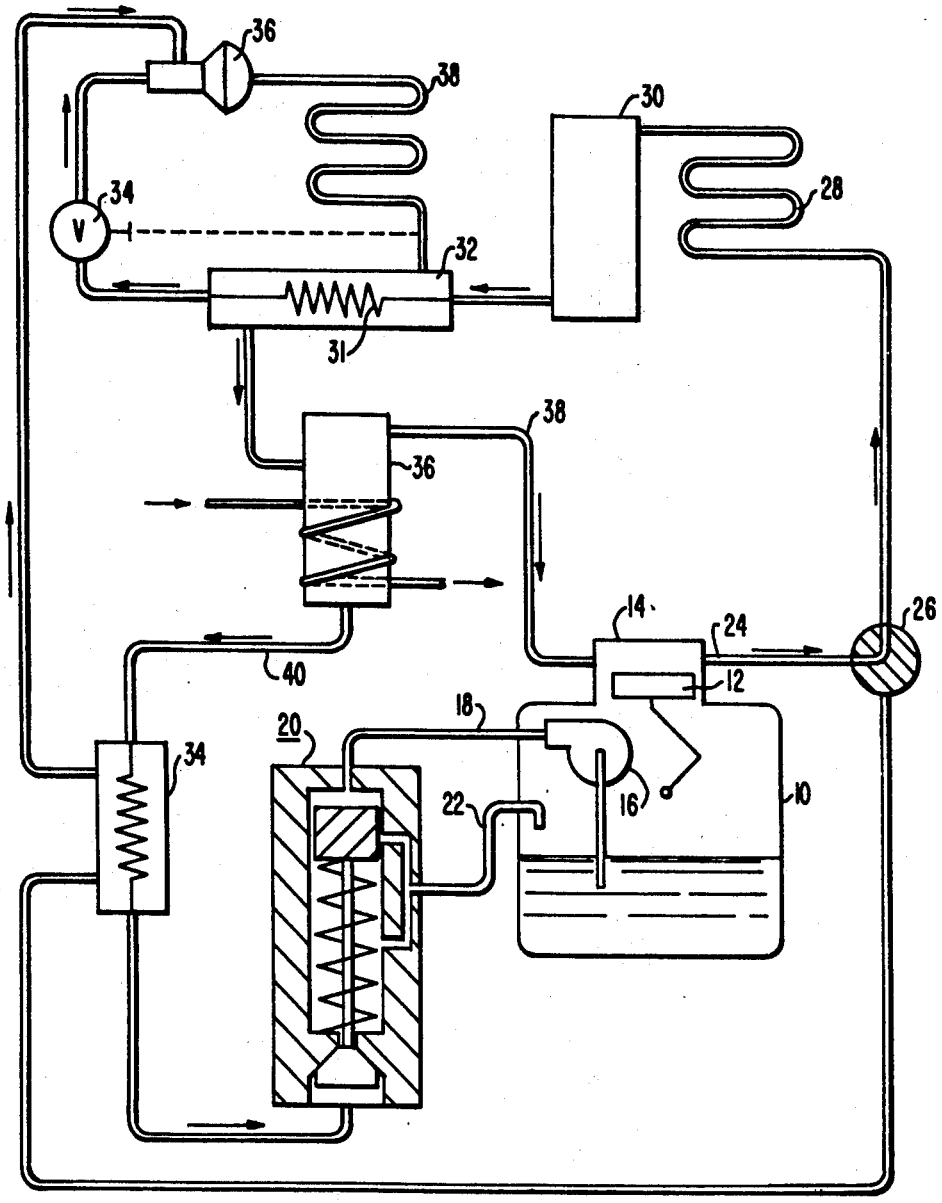
FIG. 1 is a schematic refrigeration system and lubricating oil return and recirculating system according to the present invention and in the "cooling mode"
Figure 2:
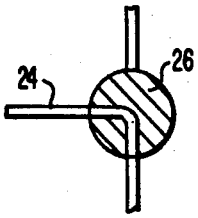
FIG. 2 is a schematic view of the valve of FIG. 1 oriented to provide a "heating mode" in the system shown therein.

Referring to FIGS. 1 and 2, it is seen that the reversible (i.e. providing both heating and cooling) transport refrigeration system comprises a compressor 10 having a reciprocating piston 12 and a cylinder chamber 14 which is driven from an external source, such as an internal combustion engine or an electric motor (not shown). The compressor 10 encloses a positive displacement recirculating oil pump 16 that delivers lubricating oil from the oil sump therein to the internal bearings and other lubricated parts of the compressor. In so doing, it is known that some of the oil becomes entrained in and carried by the refrigerant of the refrigeration system. The pump is also directly driven from the external motive source in conjunction with the compressor. The amount of oil circulated by the pump is generally in excess of the amount required to lubricate the compressor components, especially when the compressor is new and such parts fit closely together. However, as parts become worn, more and more oil is able to flow through the bearings. In any event, the excess capacity of the pump is bled off through an oil recirculating line 18 having a pressure relief valve 20 therein that opens upon actuation of the pump 16 to return the excess oil to the compressor sump through the oil return line 22. The pressure relief valve 20 will be described in greater detail subsequently.

As is well known in such refrigeration systems, the compressed refrigerant vapor is discharged from the compressor 10 into discharge line 24 and through a two-way valve 26, which in FIG. 1 is shown in a refrigeration orientation and in FIG. 2 is shown in a heating orientation.

Thus, in FIG. 1 the refrigerant vapor is directed to the condenser 28, thence into a receiver tank 30, through the internal coil 31 of a liquid/suction heat exchanger 32, and through an expansion valve 34 into a distributor 36 for circulation through the evaporator 38. From the evaporator 38 the cold refrigerant vapor passes into the liquid/suction heat exchanger 32 and on into the accumulator tank 36.

In the transport refrigeration and heating apparatus presently commercially available from the assignee of the present invention, the refrigerant and oil are separated in the accumulator tank and returned to the suction line 38 of the compressor 10 by a U-shaped aspirator tube having an oil inlet opening in the bottom as shown in U.S. Pat. No. 3,978,685 and as previously described as prior art. However, in the system of the present invention, the oil separated from the refrigerant vapor in the accumulator tank 36 is directed back to the compressor sump by a bottom drain line 40 which passes through an internal conduit 42 in a oil return heat exchanger 34 and on into an oil inlet port 44 of the valve 20 whereupon it mixes with the recirculating oil for return through a common oil return path 22. As previously explained, in this refrigeration mode the refrigerant reaching the accumulator tank 36 is primarily vapor and is directed back into the compressor 10 through the suction line 38 from an upper portion of the accumulator tank and the oil returning from the accumulator has an insignificant amount of liquid refrigerant, considered to be well within the amount the compressor is capable of receiving in the sump without damage.

With the two-way valve 26 oriented to the "heat mode" as in FIG. 2, the discharge line 24 directs the refrigerant into the oil return heat exchanger 34 from whence it flows to the distributor 36 and into the evaporator 38. In this mode, the evaporator 38 acts as the condenser of the system releasing the heat of the vapor therethrough to the space being heated. From the evaporator 38, the refrigerant flows into the liquid/suction heat exchanger 32 and then into the accumulator tank 36. In this mode, the accumulator tank 36 acts as an evaporator, and there is quite likely to be a great quantity of liquid refrigerant in mixture with the oil accumulated on the bottom of the tank. The refrigerant is vaporized from an external heat source such as hot engine coolant in coil 37 and is again directed back into the compressor through the elevated suction line 38, and the oil with any liquid refrigerant mixed therein is drained into line 40 passing through heat exchanger 34. The liquid refrigerant in this mixture, being in heat exchanging relationship with the hot discharge refrigerant vapor, vaporizes, forming a mixture of oil and vapor in the oil return line which the compressor is capable of receiving without damage or slugging, and effectively chokes the oil return line to limit the amount of oil/refrigerant vapor passing therethrough to aid in preventing liquid refrigerant from entering the compressor sump with the oil.

It is clear that alternative sources of heat can be used for heating the oil/liquid refrigerant passing through the oil return heat exchanger such as internal combustion engine coolant, engine exhaust heat, electric heat, etc., any or all of which can be used individually or as supplemental heat sources.

Figure 3:
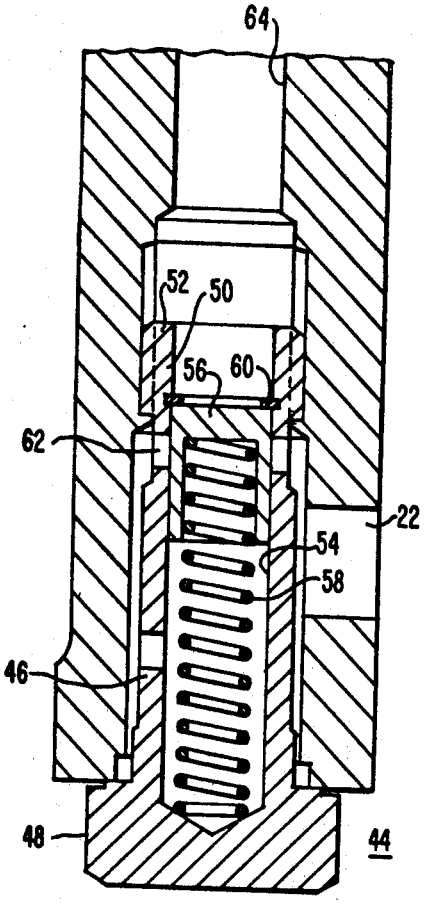
FIG. 3 PRIOR ART
FIG. 3 is a detailed view of the prior art oil recirculating pressure relief valve.

Referring now to FIG. 3, the prior art pressure relief valve of the oil recirculating system is shown. It is therein seen that the valve 45 comprises a valve body 46 having, in cross-section, a T-shaped configuration comprising an enlarged head 48 and a circular stem 50. The end of the stem 50 opposite the head has a slightly enlarged outer diameter and is externally threaded as at 52. The stem 50 has an axial bore 54 open at the threaded end. A plunger 56 is slidably disposed in the bore and a coil spring 58 is also disposed therein to normally bias the plunger outwardly into engagement with a retaining ring 60 received in an internal circumferential groove 61. A plurality of outlet ports 62 are positioned in the stem between the ring and the head. The valve is assembled (i.e. the thread end being screwed into mating threads in the oil recirculating line 18) with the compressor. The oil recirculating line can comprise an integral portion of the casing of the compressor 10 and includes an oil inlet 64 from the oil pump discharge and an oil return outlet 22 to the compressor sump. Thus, as can be seen, any excess oil from the positive displacement oil pump 16 is delivered to the oil inlet 64 which forces the plunger 56 to retract against the bias of the spring, until the outlet or bleed port 62 are opened, permitting the excess oil to flow therethrough and return to the compressor via the oil return outlet 22.

Figure 4:
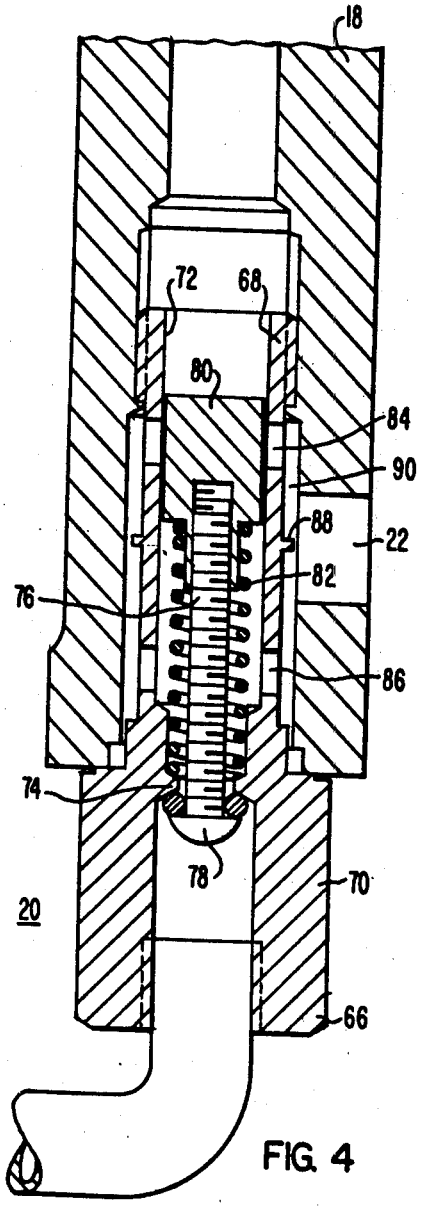
FIG. 4 is a view similar to FIG. 3 of a combination pressure relief valve and oil shut-off valve according to, and for use in the system of, the present invention.

Referring now to FIG. 4, the valve 20 of the present invention is shown disposed in the same position in the oil recirculating line 18 as the valve of FIG. 3. Valve 20 likewise has a generally T-shaped body 66 defining a stem 68 and an enlarged head 70. The stem 68 is externally threaded at its free end for threaded engagement in the oil recirculating line 18 and the head end is internally threaded for attachment to the drain line 40 from the accumulator tank. The body 66 has an axial bore 72 throughout and is open at both ends. The bore 72, adjacent the head end, has a reduced diameter portion defining an inwardly projecting annular shoulder 74. A headed valve stem 76 is slidably disposed extending axially through the inner bore with the head 78 on the lower side of the annular shoulder 74 and engaging a plunger 80 on the opposite end. A coil spring 82 is disposed encircling the slidable valve stem with one end abutting the upper face of the annular shoulder 74 and the opposite end abutting the plunger 80 to normally bias the head end 78 and an O-ring 79 into sealing engagement with the lower face of the shoulder 74 and simultaneously maintaining the plunger in a position sealing oil access to the outlet or bleed ports 84 in the idle or "at rest" position. A plurality of separate discharge ports 86 are also provided in the body 66 to place the internal bore 72 in communication with an external annular space between the body 66 and the internal diameter of the line 18 providing a flow path for the oil to return to aperture 22.

During compressor operation, oil pressure from the oil pump 16 exerts sufficient force against the plunger 80 to overcome the spring force and move the plunger 80 and valve stem 76 away from the "at rest" position to a position opening the oil return ports 84 to the annular space and ultimately aperture 22. In this position, the head 78 of the valve stem and O-ring no longer engages the lower face of shoulder 74 and the oil in the drain line 40 is permitted to flow through the axial bore 72, through the discharge port 86, and ultimately through the oil return duct or opening 22 to the crank case oil sump.

An annular separating baffle 88 around the outside of the valve body 68 and in the annular discharge space 90 tends to isolate the oil return ports 86 from the oil pressure regulating ports 84 to minimize influence of one oil discharge stream on the other.

Thus, an oil return system is shown for a transport refrigeration systems having both a heating and a cooling mode, with an oil return drain line directly from the bottom of the accumulator tank being opened only when the compressor is operating to prevent migration of liquid refrigerant to the compressor sump when the compressor is "off" and with the system providing heat to the draining oil, at least during the heating mode of operation of the refrigeration system, to minimize liquid refrigerant being returned to the sump with the oil when the compressor is running and in the mode most apt to provide liquid refrigerant in the oil from the accumulator tank.

I claim:

1. A valve including:

an outer body and an interior sleeve with an axially extending bore, said body and sleeve defining an annular chamber therebetween;

a primary and a secondary fluid inlet at opposite axial ends of the valve to receive fluid from a primary source and a separate secondary source;

axially movable valving means in the bore including a valve stem having one valving element at its head end and a plunger at its other end;

an annular shoulder in said sleeve forming a valve seat for said valving element;

said sleeve includes first and second radial valve port means interconnecting said bore with said annular chamber, said plunger being movable between positions opening and closing said first port means;

means biasing said valving means as a unit in a direction to seat said valving element of the valve stem and to locate said plunger in a position closing said first radial port means, and in opposition to primary fluid pressure tending to move said valving means axially toward an open position; and a single fluid outlet in said body communicating with said annular chamber to receive all of the flow from both the primary and secondary sources when said valving means is open.

2. A valve according to claim 1 including baffle means in said annular chamber between said first and second radial valve port means.

* * * * *